US012084216B2

(12) United States Patent
Knubel

(10) Patent No.: US 12,084,216 B2
(45) Date of Patent: Sep. 10, 2024

(54) EMPTYING DEVICE AND METHOD FOR EMPTYING A SILO OF A PACKAGING SYSTEM

(71) Applicant: HAVER & BOECKER OHG, Oelde (DE)

(72) Inventor: Heiner Knubel, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 52 days.

(21) Appl. No.: 17/904,032

(22) PCT Filed: Feb. 9, 2021

(86) PCT No.: PCT/EP2021/053005
§ 371 (c)(1),
(2) Date: Aug. 11, 2022

(87) PCT Pub. No.: WO2021/160574
PCT Pub. Date: Aug. 19, 2021

(65) Prior Publication Data
US 2023/0081759 A1 Mar. 16, 2023

(30) Foreign Application Priority Data
Feb. 13, 2020 (DE) ..... 102020103711.2

(51) Int. Cl.
*B65B 39/00* (2006.01)
*B65B 65/00* (2006.01)

(52) U.S. Cl.
CPC ..... *B65B 39/00* (2013.01); *B65B 65/006* (2013.01); *B65B 2210/08* (2013.01)

(58) Field of Classification Search
CPC ..... B65B 65/006; B65B 65/00; B65B 39/00; B65B 2210/08; B65B 1/18; B08B 5/04; B08B 9/08; B08B 9/027
(Continued)

(56) References Cited

U.S. PATENT DOCUMENTS 2,756,859 A * 7/1956 Steffen ..... B65G 47/72 198/368
4,347,922 A * 9/1982 Curry ..... B65G 47/72 193/23
(Continued)

FOREIGN PATENT DOCUMENTS

AT 384593 B 12/1987
CH 692334 A5 * 5/2002 ..... B08B 5/04
(Continued)

OTHER PUBLICATIONS

International Search Report and Written Opinion received for PCT/EP2021/053005, mailed Jun. 1, 2021.
(Continued)

*Primary Examiner* — Andrew M Tecco
(74) *Attorney, Agent, or Firm* — Greer, Burns & Crain, Ltd

(57) ABSTRACT

An emptying device for completely emptying at least one silo of at least one rotary packaging system, and rotary packaging system, including at least one silo, at least two filling stations with at least one filling spout each in connection with the silo, and such an emptying device, including a discharge pipe with a take-up opening. The longitudinal extension of the take-up opening is larger than its transverse extension. In the method for completely emptying a silo of a rotary packaging system with two filling stations with one filling spout each and such an emptying device, the packaging system is provided for rotating continuously during emptying.

15 Claims, 7 Drawing Sheets

(58) Field of Classification Search
USPC ..... 53/202
See application file for complete search history.

(56) References Cited

U.S. PATENT DOCUMENTS

| | | | | | |
|---|---|---|---|---|---|
| 5,215,127 | A * | 6/1993 | Bergeron | ..... | B65G 47/72 141/10 |
| 10,457,427 | B2 * | 10/2019 | De Boer | ..... | B65B 9/045 |
| 2019/0127091 | A1 * | 5/2019 | De Boer | ..... | B65B 35/02 |

FOREIGN PATENT DOCUMENTS

| | | | | | |
|---|---|---|---|---|---|
| CN | 108499981 | A * | 9/2018 | ..... | B01D 46/12 |
| DE | 3414218 | A1 | 10/1985 | | |
| DE | 29622064 | U1 | 3/1997 | | |
| EP | 3357820 | A1 | 8/2018 | | |

OTHER PUBLICATIONS

German Search Report received for Application No. 102020103711.2 , dated Jan. 23, 2021.

* cited by examiner

EMPTYING DEVICE AND METHOD FOR EMPTYING A SILO OF A PACKAGING SYSTEM

BACKGROUND

The present invention relates to an emptying device for completely emptying at least one silo of at least one rotary packaging system. Such a rotary packaging system comprises at least two filling stations with at least one filling spout each, and preferably at least one conveyor element such as a conveyor turbine. The emptying device comprises at least one discharge pipe with at least one take-up opening. The present invention moreover comprises a rotary packaging system with such an emptying device and a method for emptying a silo of a packaging system by means of such an emptying device.

Rotary packaging systems comprise multiple filling stations with filling spouts distributed over the circumference. Each of the filling spouts is supplied with product respectively bulk material from at least one silo which tends to be positioned centrally. Depending on the system configuration, whether valve bags or open-mouth bags are filled, a plurality of further components respectively parts may be provided for the packaging system respectively the filling stations.

The packaging system rotates, and while the packaging system rotates, the bags are appended, filled, and discharged from the system for transportation.

In the case of product changes, some product residue may possibly be left in the silo. In order to achieve fast, and above all tidy, complete emptying, assemblies for completely emptying are known in the prior art. As a rule, these systems comprise a suction duct with an opening matching the contour of the filling spout.

As a rule, the rotary packaging machine runs in a start-stop operation while completely emptying. Then the packaging system rotates until a filling spout is situated in front of the opening of the assembly for completely emptying. Depending on the configuration, the opening of the suction duct is moved across the filling spout, and the bulk material is conveyed out of the silo through the filling spouts into the suction duct. Then the product is conveyed further from there. Such a packaging machine with a returning device is described for example in DE 29622064 U1.

For completely emptying, the packaging system must perform at least one complete rotation since every filling spout must be blown out at least once into the opening of the suction duct, since the conduction paths from the silo to the filling spout must also be emptied. Each of the filling spouts has its own discharge cone so that, when the product level is still too high in the silo, the product can trickle down during the further rotation, which necessitates at least one more revolution in indexed operation.

The drawback of the known systems is that they need to perform complete emptying during a start-stop operation. This reduces the speed of complete emptying. Another particular drawback is that the components of the rotary packaging system are not designed for start-stop operation. Due to the large moving masses, considerable forces act on each of the parts during the start-stop operation. This results in the fact that specific components must be used, e.g. larger drives and/or heavy-duty brakes, to prevent defects in the system.

It is therefore the object of the present invention to provide complete emptying respectively high-speed emptying which can be performed fast while the loads acting on the components are reduced, compared to known systems.

SUMMARY

The emptying device according to the invention is suitable for completely emptying respectively high-speed emptying at least one silo of at least one rotary packaging system with at least two filling stations having at least one filling spout each. The emptying device comprises at least one discharge pipe with at least one take-up opening, wherein the take-up opening shows a longitudinal extension larger than its transverse extension.

The emptying device according to the invention is suitable for completely emptying respectively high-speed emptying respectively for an emptying run of a rotary packaging system respectively of the silo and preferably also the supply lines from the silo to the filling spout of a packaging system, without filling into bags the goods respectively bulk material intended for filling contained in the silo. To this end, the bulk material contained in the silo is blown, conveyed, respectively guided, out of the filling spouts into the drain line and thus can be homogeneously conveyed to re-usage.

The fact that the take-up opening shows a longitudinal extension larger than its transverse extension in particular means that it is substantially configured elongated, wherein longitudinal extension in particular defines the horizontal extension of the take-up opening.

The elongated configuration respectively the longitudinal extension that is larger than the transverse extension of the take-up opening means in particular that the longitudinal extension of the opening is at least 1.5 times the transverse extension or twice the extension or even more.

The emptying device according to the invention comprises in particular at least one conveyor element, wherein the product respectively bulk material conveyed into the take-up opening can be conveyed off in a suitable way by means of said conveyor element. Then the take-up opening is for example configured as a suction aperture. Depending on the configuration, the product may preferably be conveyed off respectively further passively, respectively by means of gravity, by a suitably inclined removal device.

The emptying device according to the invention offers many advantages. It is a considerable advantage that the special configuration of the take-up opening of the emptying device, the longitudinal extension of which is larger than its transverse extension, enables a continuous operation of the packaging system during completely emptying respectively high-speed emptying. Namely, the elongated configuration of the take-up opening allows the filling spout to pass through the suction intake while the packaging system is rotating, unlike as is known in the prior art, where it is pushed onto the filling spout during a start-stop operation.

In known systems for completely emptying, the take-up opening is adapted to the filling spout profile such that the suction intake is pushed onto the filling spout in a close fit. Thus, completely emptying can only be performed in a start-stop operation.

The permanent respectively continuous rotation of the packaging system during complete emptying out of the silo and the filling paths to the filling spouts allows the installation of standard components. The rotational speed may in particular be constant or it may vary, wherein the system is preferably not provided to stop. A reduced rotational speed may in particular be provided compared to the filling operation.

The forces acting on the packaging system are not stronger than in a normal filling operation. A start-stop operation in packaging systems shows considerable drawbacks as described above, since the relatively large mass of the filled system generates considerable forces acting on each of the components in a start-stop operation.

Preferably, the take-up opening is adapted to the circumference of the packaging machine at least in sections. A curved respectively arcuate outline of the take-up opening is in particular provided, at least in sections.

Particularly preferably, the take-up opening has at least one effective angle. This effective angle in particular describes the distance which a filling spout travels during rotation through the take-up opening respectively along the longitudinal extension of the take-up opening. Thus, product can be conveyed into the take-up opening over the longest time period possible, while the packaging system is rotating. The effective angle in particular depends on the number of filling stations and thus on the number of filling spouts and thus, on the diameter of the packaging system. The smaller the number of filling spouts, the smaller is the diameter of the packaging system and thus, the larger is the effective angle.

In expedient configurations, the take-up opening shows a substantially U-shaped and/or V-shaped cross section in the transverse extension. This results in particular in providing a passage opening for the filling spout. It is in particular provided for the side walls of the suction intake to be provided with a recess corresponding to the cross section of the suction intake, such that the filling spout can move into the suction intake from the side, respectively passes through transversely, such that the suction intake does not need to be pushed onto the filling spout, depending on the configuration.

In advantageous configurations, the U-shaped respectively V-shaped cross section is provided by suitable attachments to the suction intake.

Preferably, the discharge pipe is provided pivotable at least in sections. What is provided pivotable is in particular the part of the discharge pipe with the take-up opening. Preferably, the discharge pipe can pivot about a substantially horizontal pivot axis, so that the suction duct can pivot forwardly and rearwardly, respectively can be turned upwardly and downwardly.

Preferably, the discharge pipe is provided for displacement between at least one rest position and at least one emptying position. Thus, the discharge pipe can be displaced to a non-impeding rest position during the normal filling operation. For emptying the silo, the discharge pipe can then be traversed to an emptying position, wherein intermediate positions may be provided in particular for exchanging filling spouts.

In advantageous specific embodiments, the discharge pipe is provided traversable at least in sections. The discharge pipe is in particular provided pivotable and traversable. In all the configurations, traversable means in particular, traversing the discharge pipe forwardly and rearwardly. Depending on the configuration, further components assigned to the discharge pipe can preferably be traversed along with it.

Thus, a pivotable and traversable configuration of the discharge pipe in particular allows to provide the discharge pipe respectively the take-up opening for normal operation of the packaging system at a sufficient distance from the packaging system respectively the filling spouts. When changing filling spouts in rotary operation, the take-up opening can then be moved near the filling spouts respectively across the filling spout at least in sections, for completely emptying. The majority of the path towards the filling spout can then preferably be pivoted, wherein, depending on the configuration, attachments to the filling spout or to the packaging system may necessitate travelling at least part of the distance to the filling spout by traversing the suction duct respectively the take-up opening.

Preferably, the take-up opening is provided with at least one protective device. Such a protective device may for example comprise at least one protective edge respectively protective panel, which is/are provided in particular in the bottom region of the take-up opening. Such a protective edge can for example catch any product trickling out of the filling spout respectively bulk material having a low outlet speed.

Preferably, at least one dedusting device is assigned to the take-up opening. Such a dedusting device may preferably comprise one or multiple openings, through which any dust generated in completely emptying can be sucked off. These openings respectively the dedusting device may be provided above, beneath, or laterally of, the take-up opening.

Particularly preferably the emptying device is configured mobile. Thus, it may in particular be configured traversable respectively displaceable, so as to provide for use for example in multiple packaging systems.

The rotary packaging system according to the invention comprises at least one silo for product intended for filling, at least two filling stations with at least one filling spout connected with the silo, and at least one emptying device as described above.

The packaging system in particular rotates such that the two filling stations respectively the filling spouts of the filling stations rotate over the circumference, so that in normal operation respectively filling operation any bags pushed onto, or otherwise connected with, the filling spouts, can be filled with bulk material from the silo during rotation of the packaging system.

When completely emptying the silo, for example in the case of product changes in the system, the silo and any bulk material still remaining in the supply lines to the filling spouts, can be blown out respectively conveyed out into the emptying device.

The packaging system according to the invention also offers the advantages set forth above regarding the emptying device. The rotary packaging system can in particular be completely emptied in a continuous respectively permanent rotary operation.

The method according to the invention is suitable for completely emptying a silo of a rotary packaging system comprising at least two filling stations with at least one filling spout and at least one emptying device each, as described above, and according to the invention it is characterized in that the packaging system rotates continuously during emptying respectively completely emptying respectively high-speed emptying.

A continuous rotation is in particular provided respectively is understood to mean, according to the invention, that in completely emptying respectively high-speed emptying, the packaging system does not run in a start-stop operation but is rotating such that the method according to the invention likewise achieves the advantages described above. Thus, continuous rotation is in particular understood to also include rotation at varying rotational speeds. Thus, what is meant is in particular a continuous rotation, not necessarily a continuous rotational speed.

Preferably, the packaging system rotates at a peripheral speed that is reduced when compared to a filling operation. Thus, it is in particular possible to provide for the longest possible passage time of the filling spout through the take-up opening without providing for a start-stop operation of the packaging system. Depending on the configuration of the packaging system and the type of the bulk material intended for filling, considerable quantities of bags can be filled hourly in a filling operation. In a filling operation, this also results in relatively high peripheral speeds. Thus, it is advantageous and preferred to reduce the speed respectively the rotation speed of the packaging system in the emptying operation.

Particularly preferably, the discharge pipe is traversed and/or pivoted at least when changing filling spouts. This configuration also allows to continuously rotate the packaging system independently of attachments to the filling spout and/or to the remainder of the packaging system. Thus, in particular when changing filling spout, the discharge pipe respectively the take-up opening can be pivoted, and depending on the configuration also traversed, in the direction of the filling spout.

Preferably, at least one conveyor element such as a filling turbine, an auger and/or an air conveyor of the packaging machine, conveys the residual product out of the rotary silo respectively during rotation of the packaging system into the take-up opening, through the filling spout when passing it. The filling turbine can preferably be operated such that a sufficient quantity of bulk material is blown out through a filling spout.

Particularly preferably, the entire silo is emptied by way of emptying the bulk materials at intervals through the filling spouts. Thus, it is in particular possible that during the continuous rotation of the packaging system, each filling spout passes through the take-up opening multiple times, depending on the quantity of residual product in the silo, until the entire silo and preferably also the supply lines to the filling spouts are emptied.

Preferably, emptying is started automatically during a preset effective angle respectively rotation angle, and stopped again, in dependence on the longitudinal extension of the take-up opening respectively the effective angle. This may preferably be sensor-controlled, or solely done by means of the effective angle. This allows to save considerable time compared to completely emptying in a start-stop operation.

BRIEF DESCRIPTION OF THE DRAWINGS

Further advantages and features of the present invention can be taken from the exemplary embodiment which will be described below with reference to the enclosed figures.

The figures show in.

DETAILED DESCRIPTION

Figure 1:
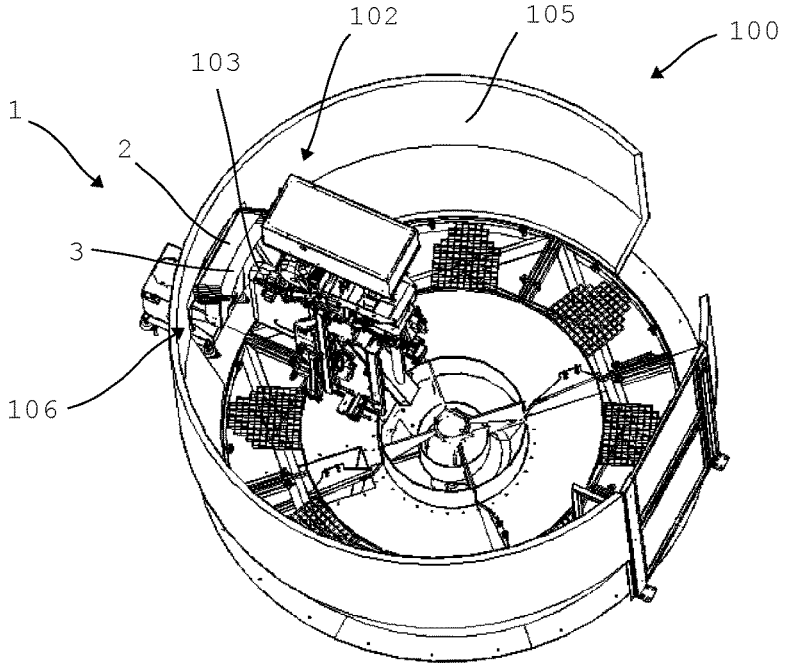
FIG. 1 a schematic illustration of a packaging system according to the invention with an emptying device according to the invention in a perspective plan view.

FIG. 1 illustrates a packaging system 100 according to the invention with an emptying device 1 according to the invention in a schematic, perspective plan view.

The packaging system 100 according to the invention is configured as a rotary packaging system 100 and comprises multiple filling stations 102 disposed distributed over the circumference of the packaging system 100. FIG. 1 shows one filling station 102 only. Each of these filling stations 102 comprises a filling spout 103 where a bag intended for filling is filled while the packaging system 100 is rotating.

In the center of the packaging system 100, a silo 101, not shown in FIG. 1, is provided, which supplies, via dedicated supply lines, product intended for filling from the silo 101 to each of the filling stations 102 respectively the filling spouts 103.

In the exemplary embodiment shown, each of the filling stations 102 respectively each filling spout 103 is provided with a conveyor element 104, presently a filling turbine 104, by means of which product can be filled into a bag 200 intended for filling.

In the exemplary embodiment shown, a housing structure 105 is provided over the circumference around the packaging system 100, wherein in the housing structure 105 a clearing device 106 is provided through which the emptying device 1 respectively the discharge pipe 2 with the take-up opening 3 of the emptying device 1 can establish a functional connection with the filling spouts 103 of the filling stations 2 rotating past.

Figure 2:
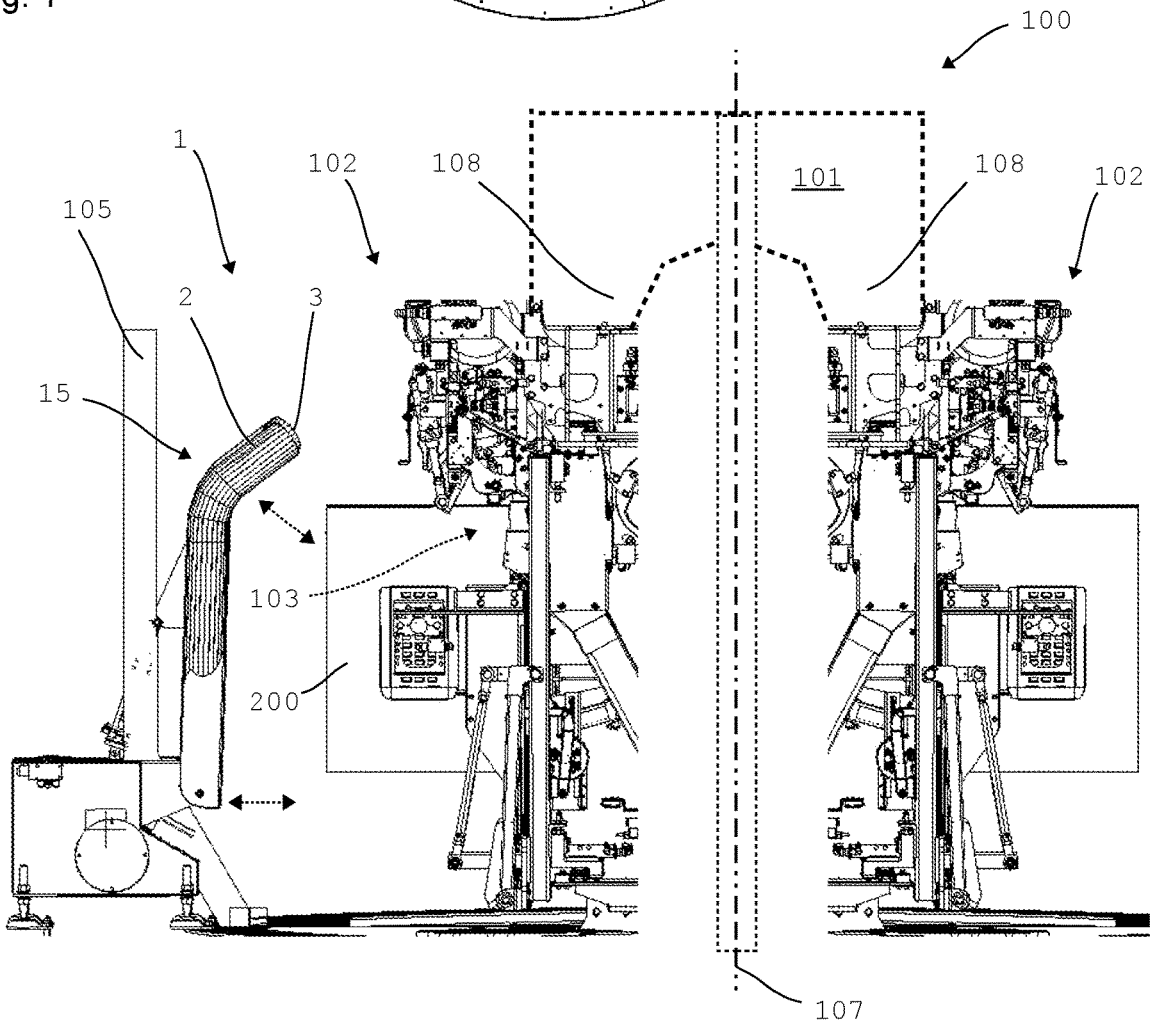
FIG. 2 a schematic illustration of a packaging system according to the invention with an emptying device according to the invention in a side view with the discharge pipe flipped up.

FIG. 2 schematically shows a packaging system 100 according to the invention respectively rotary packaging system 100 with an emptying device 1 according to the invention, wherein the discharge pipe 2 is moved respectively pivoted back. Thus, the discharge pipe is in the rest position 15. Then the packaging system 100 can rotate unimpeded in the normal filling operation for filling bulk material respectively product into bags 200.

In the exemplary embodiment shown, a silo 101 is provided comprising outlet cones 108 matched to the quantity of the filling stations, through which the product respectively the bulk material is supplied to the individual filling stations 2 respectively filling spouts 103.

For completely emptying, the discharge pipe 2 in the exemplary embodiment shown can be pivoted forwardly and moreover, traversed forwardly, such that the discharge pipe comes to be in the emptying position 16, in which the filling spout passes through the elongated take-up opening 3. Then, during the rotation of the packaging system 100, product can be blown respectively conveyed through the filling spout 103 out of the silo 101 into the take-up opening 3. To this end, the rotation speed can be adapted and in particular reduced as compared to the filling operation, depending on the configuration.

Depending on the configuration, the emptying device 1 according to the invention comprises at least one conveyor element, not shown in detail, wherein the product respectively bulk material conveyed into the take-up opening 3, can be conveyed off by means of this conveyor element in a suitable way. Depending on the configuration, however, the product may proceed solely on the basis of gravity e.g. into a collecting container provided.

Figure 3:
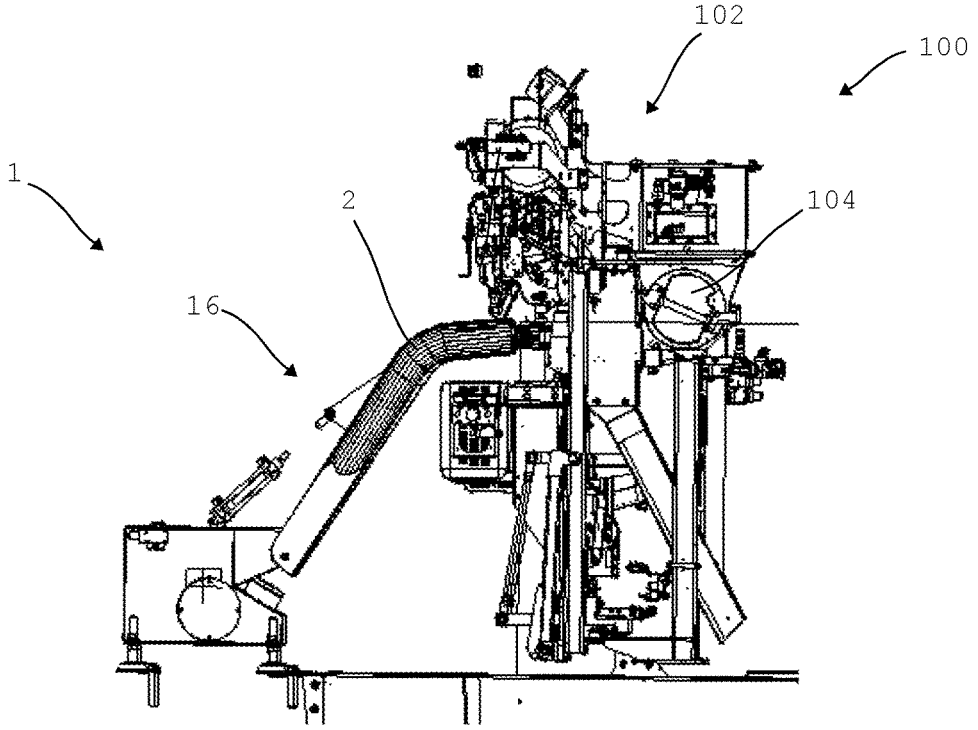
FIG. 3 a schematic illustration of a packaging system according to the invention with an emptying device according to the invention in a side view with the discharge pipe in functional connection with a filling spout.

FIG. 3 is a schematic illustration of a packaging system 100 according to the invention with an emptying device 1 according to the invention, wherein the take-up opening 3 of the discharge pipe 2 of the emptying device 1 is mounted in functional connection with a filling spout 103 of an empty filling station 102 of the packaging system 100 according to the invention, to perform complete emptying respectively high-speed emptying of the packaging system 100.

To this end, the product is not filled into bags 200 out of the silo 101, as shown in FIG. 2, but supplied to the emptying device 1 through the filling spouts 103. To this end, product is blown out of each of the filling spouts 103 into the take-up opening 3, as the pertaining filling spout 103 is brought into a functional connection with the take-up opening 3. Then the product is conveyed further in a suitable way through the discharge pipe 102.

Figure 4:
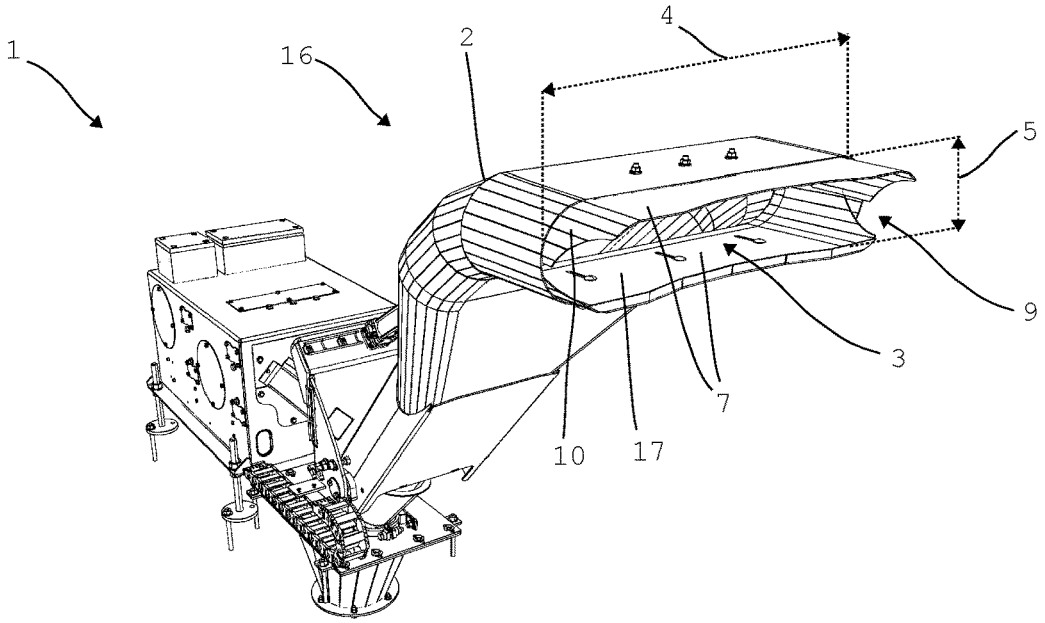
FIG. 4 a schematic illustration of an exemplary embodiment of an emptying device according to the invention in a perspective view.

FIG. 4 schematically shows an exemplary embodiment of an emptying device 1 according to the invention, in a perspective front view.

Again one can see that the emptying device 1 comprises a discharge pipe 2 with a take-up opening 3. The take-up opening 3 according to the invention is configured such that the longitudinal extension 4 is larger than the transverse extension 5.

The elongated configuration of the take-up opening 3 provides a take-up opening 3 according to the invention which is not, as in the prior art, adapted, respectively docked, to the contour of the filling spout 103, but is provided such that during rotation of the packaging system 100 the filling spout 103 can pass through the take-up opening 3 for an extended time period.

To this end, the cross section 9 of the take-up opening 3 is configured substantially U-shaped respectively V-shaped respectively in a suitable profile. In the exemplary embodiment shown, the appropriate configuration of the wall 10 of the discharge pipe 2 in the region of the take-up opening 3 achieves that, depending on the configuration, a filling spout 103 rotating past can laterally dip respectively move into the take-up opening 3.

Figure 5:
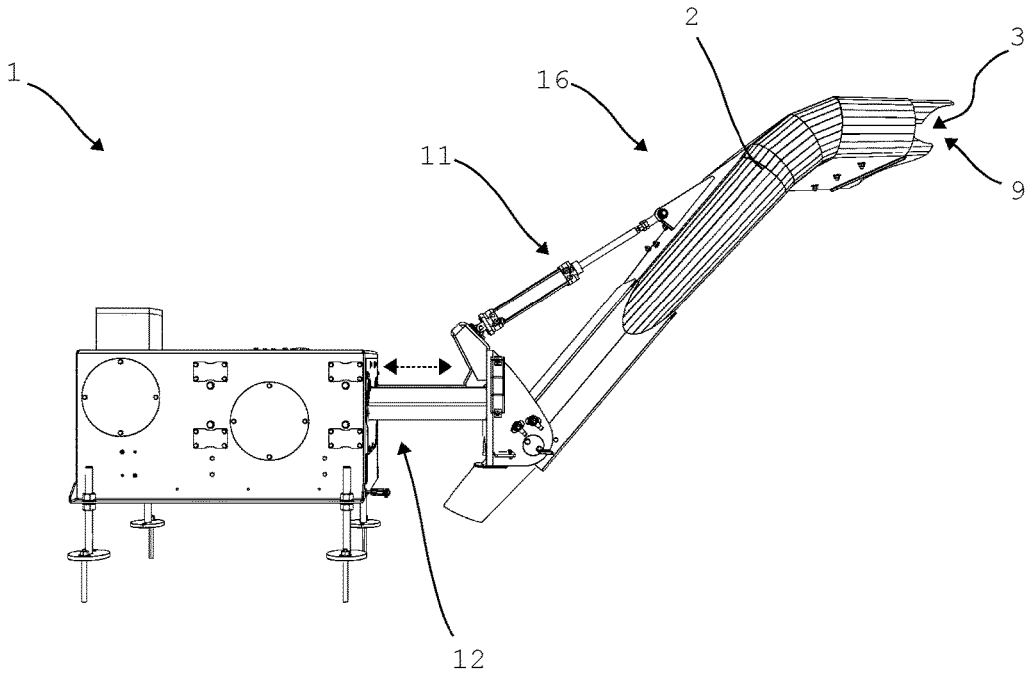
FIG. 5 a schematic illustration of the exemplary embodiment according to FIG. 4 in a side view.

FIG. 5 illustrates the exemplary embodiment of an emptying device 1 according to the invention according to FIG. 4 in a side view.

One can recognize a displacement mechanism 11 for pivoting the discharge pipe 2 and a displacement mechanism 12 for traversing the discharge pipe 2. One can further recognize the V-shaped respectively U-shaped cross section 9 of the take-up opening 3.

Figure 6:
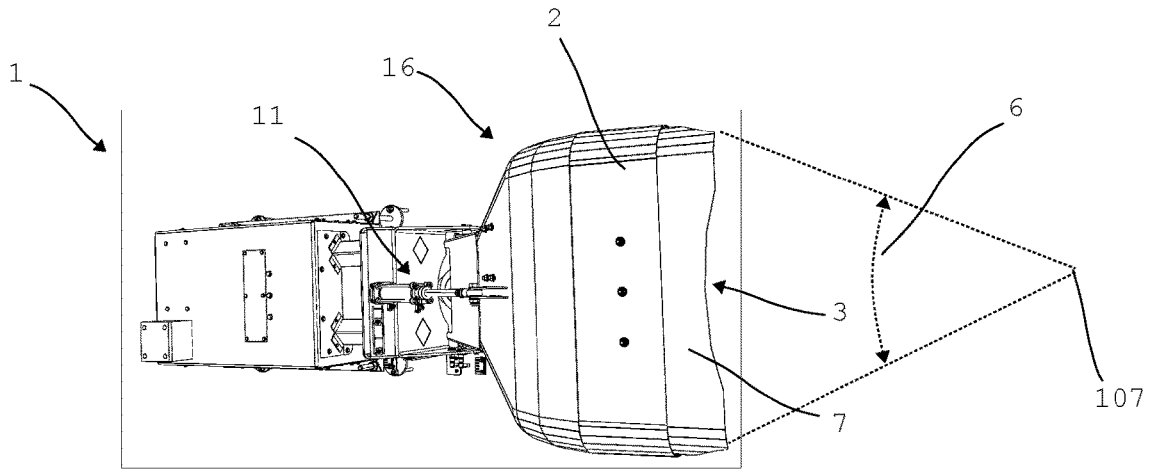
FIG. 6 a schematic illustration of the exemplary embodiment according to FIG. 4 in a plan view.
Figure 7:
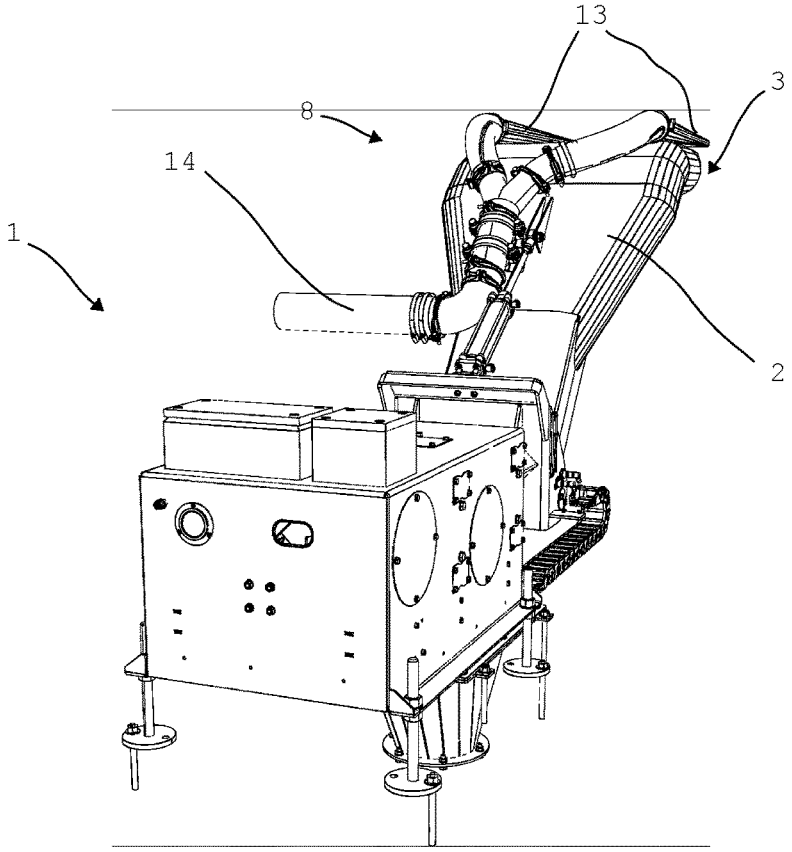
FIG. 7 a schematic illustration of another exemplary embodiment of an emptying device according to the invention in a perspective rear view.
Figure 8:
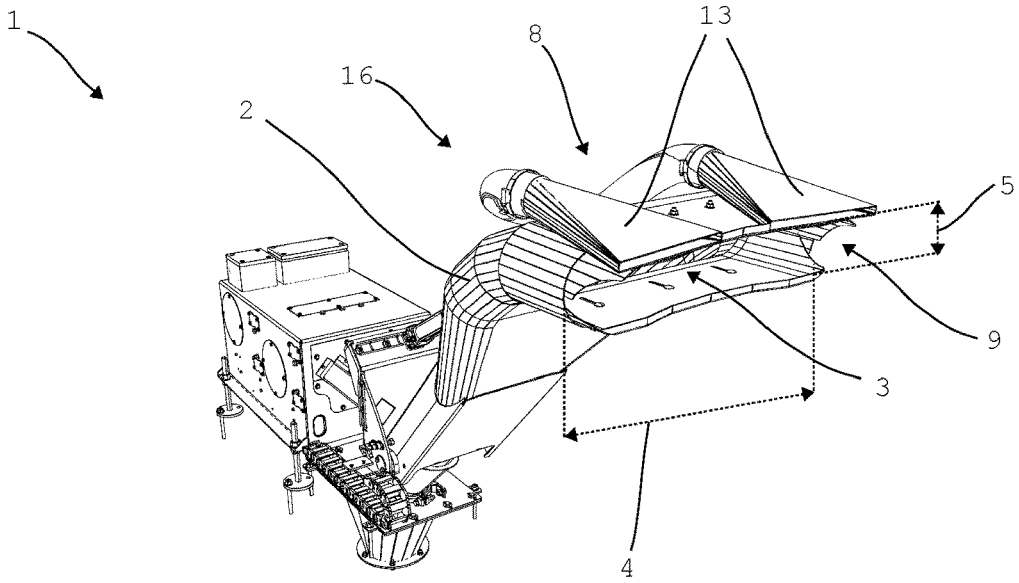
FIG. 8 a schematic illustration of the exemplary embodiment according to FIG. 7 in a perspective front view.
Figure 9:
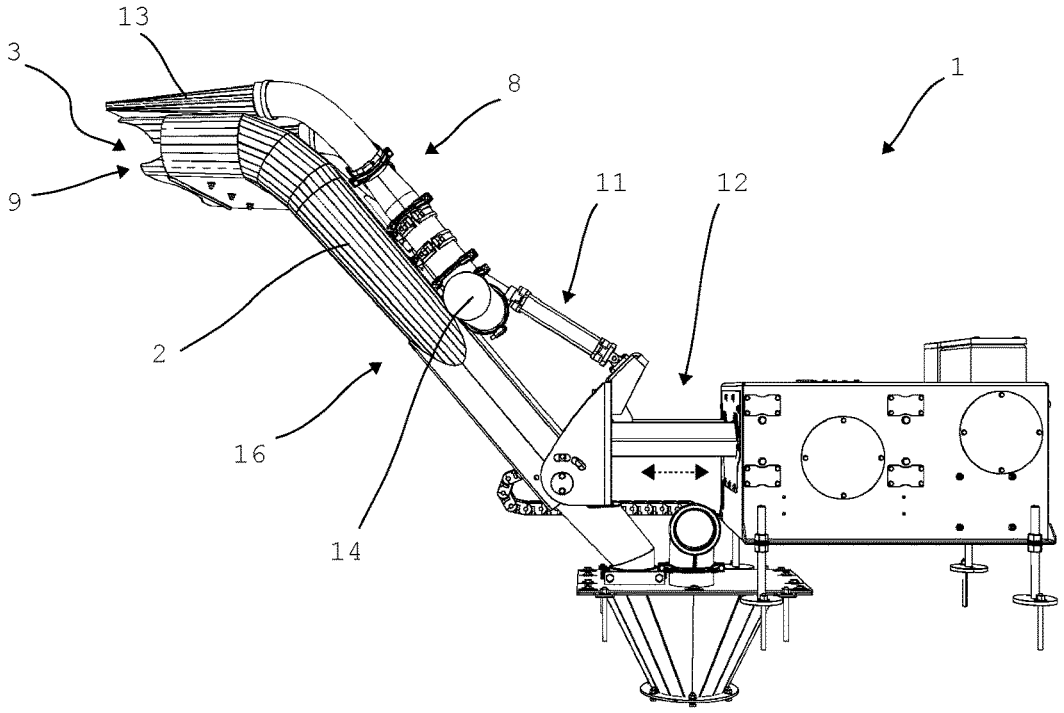
FIG. 9 a schematic illustration of the exemplary embodiment according to FIG. 7 in a side view.
Figure 10:
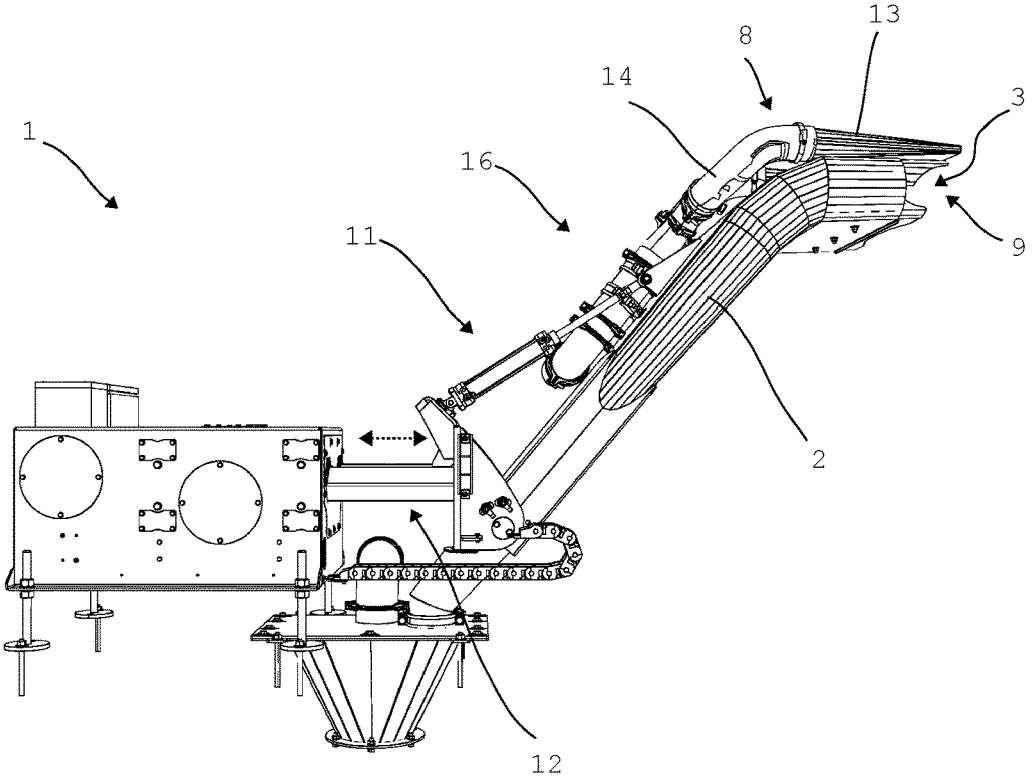
FIG. 10 a schematic illustration of the exemplary embodiment according to FIG. 7 in another side view.

FIG. 6 illustrates the exemplary embodiment of an emptying device 1 according to the invention according to the FIGS. 4 and 5 in a plan view.

One can recognize that the take-up opening 3 is matched to the circumference of the packaging system 100, to which end it is configured substantially slightly bent respectively arcuate.

Moreover one can recognize that the take-up opening is provided with an effective angle 6, which defines a distance that a filling spout 103 travels through, respectively along, the take-up opening 3 during the rotation. The effective angle 6 is viewed from the center of rotation 107 of the packaging system 100.

Such a configuration of the take-up opening 3 particularly allows to achieve that when passing through the elongated take-up opening 3, a filling spout 103 is in functional connection with the take-up opening 3 respectively the emptying device 1 as long as possible. Thus, during the rotation, in particular during a continuous rotation of the packaging system 100, completely emptying respectively high-speed emptying of the silo 101 can be enabled. A start-stop operation as in conventional systems is not necessary since the suitably configured take-up opening 3 allows continuous operation respectively rotation of the packaging system 100.

The FIGS. 4 to 6 moreover illustrate that a protective device 7 is assigned to the take-up opening 3. The protective device 7 shown comprises, in the bottom face of the take-up opening 3, an edge 17 on which any bulk material respectively product trickling down is caught. Such caught product can then be sucked off through, or slide into, the discharge pipe 2, or be sucked off by means of the dedusting device 8.

The FIGS. 7 to 10 illustrate another exemplary embodiment of an emptying device 1 according to the invention for a packaging system 100 according to the invention in a variety of perspective and side views.

Unlike the exemplary embodiment shown above, the take-up opening 3 is provided with a dedusting device 8, which during completely emptying respectively high-speed emptying sucks off any dust generated, so as to achieve a particularly clean complete emptying.

To this end, the dedusting device 8 in the exemplary embodiment shown, comprises two suction funnels 13 disposed in the top region of the take-up opening 3. The two suction funnels 13 respectively dust removal funnels 13 converge in a dust removal line 14 which allows to convey the sucked-off dust further.

Depending on the configuration, the suction funnels 13 respectively dust removal funnels may be provided on the bottom and/or sides of the take-up opening 3.

Figure 11:
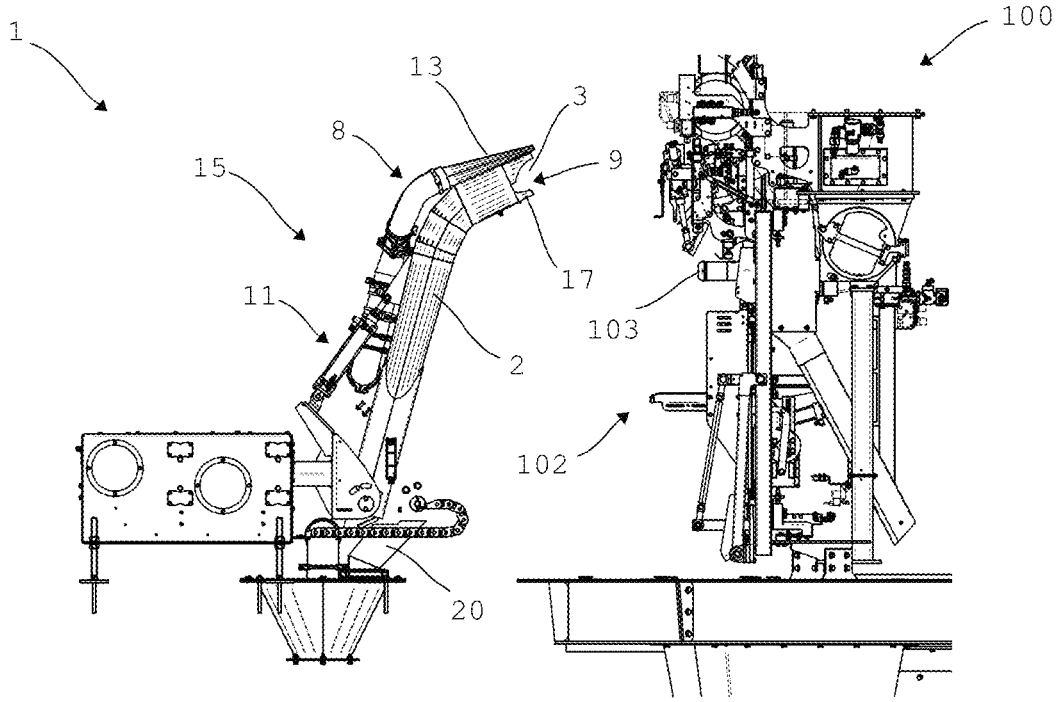
FIG. 11 a schematic illustration of another exemplary embodiment of a packaging system according to the invention in a side view with the emptying device in the rest position.
Figure 12:
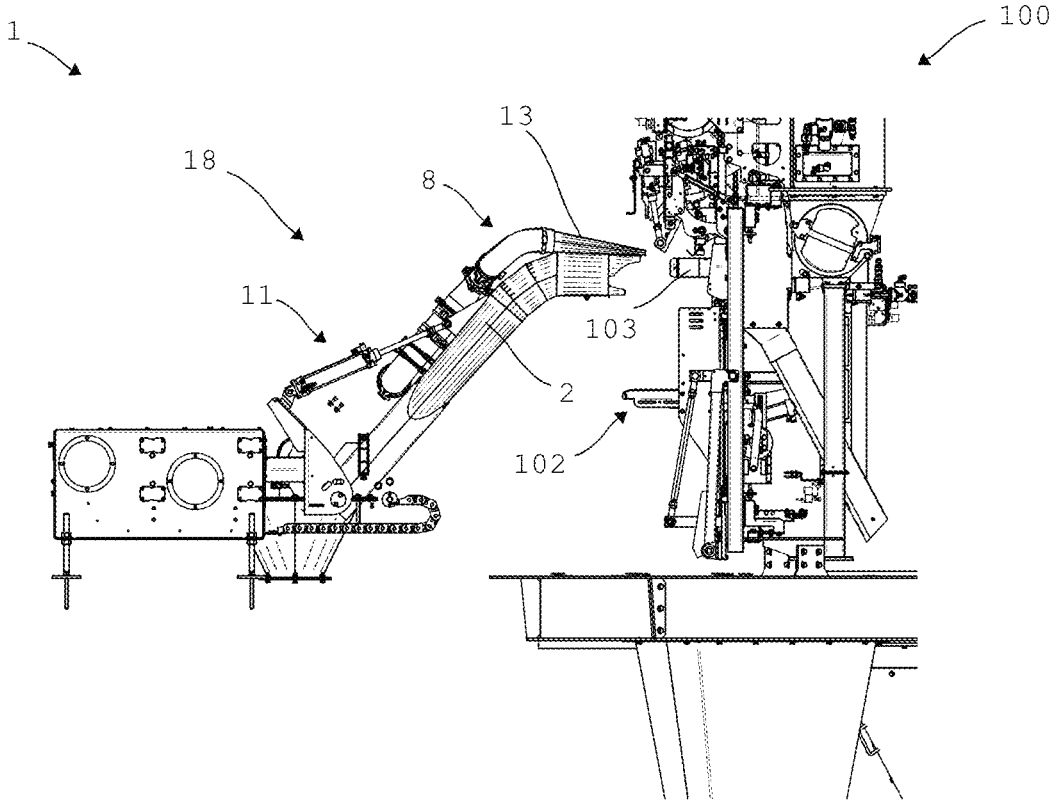
FIG. 12 a schematic illustration of the exemplary embodiment according to FIG. 11 with the emptying device in an intermediate position.
Figure 13:
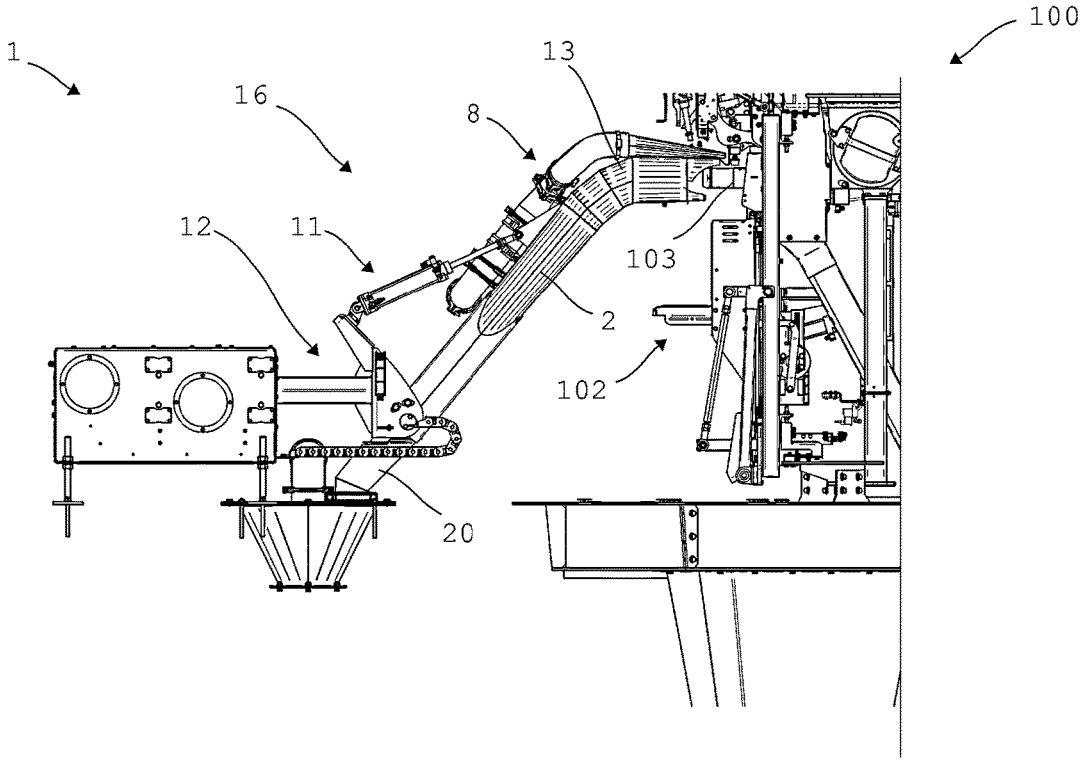
FIG. 13 a schematic illustration of the exemplary embodiment according to FIG. 11 with the emptying device in the emptying position.

The FIGS. 11 to 13 schematically illustrate the sequence of motions of the suction duct 2 of an emptying device 1 according to the invention of a packaging system 100 according to the invention, as completely emptying starts. The basic structure of the emptying device 1 substantially corresponds to the exemplary embodiment described above.

FIG. 11 shows the discharge pipe 2 of the emptying device 1 in the rest position 15. The discharge pipe 2 of the emptying device 1 is in this position while the packaging system 100 runs in the normal filling operation.

If the silo 101 of the packaging system 100 is to be completely emptied, the suction duct 2 as shown in FIG. 12 in the exemplary embodiment shown is first pivoted forwardly by means of the displacement mechanism 11. In this intermediate position 18, the take-up opening 3 in the exemplary embodiment shown is located on the level of the filling spout 103, but still spaced apart some distance.

Due to the components provided on and around the filling spout 103, such as an ultrasound welding station, suction ducts, etc., the take-up opening 3 in the exemplary embodiment shown cannot be brought sufficiently near to the filling spouts 103 by way of pivoting alone.

Therefore, the discharge pipe 2 respectively the take-up opening 3, as shown in FIG. 13 in the exemplary embodiment shown, is then traversed forwardly to the emptying position 16 by means of the displacement mechanism 12, after pivoting.

In this position, during rotation of the packaging system 100, the filling spouts 103 pass through the take-up opening 3, conveying the product out of the silo 101 into the emptying device 1.

Then the filling spouts 103 dip into the opening 3 far enough so that any product trickling down is caught by the protective device 7 respectively the edge 17.

Due to the U-shaped respectively V-shaped or the like configuration of the cross section 9 of the take-up opening 3, the discharge pipe 2 respectively the take-up opening 3 in the exemplary embodiment shown does not require traversing when changing filling spouts. Each of the filling spouts 103 can move into, respectively through, the take-up opening 3.

Depending on the configuration, traversing of the discharge pipe 2 from the emptying position 16 to the intermediate position 18 or even the rest position 15 may be provided in changing filling spouts.

Comparing the FIGS. 11 and 13, one can also see that in the exemplary embodiment shown, the discharge pipe 2 is connected with a line 19 in terms of flow dynamics, in the emptying position 16. The product can be suitably conveyed further through this line 19.

The line 19 is presently configured stationary and the discharge pipe 2, configured separately, is separated from the line 19 in displacing from the emptying position to the intermediate position 18 or the rest position 15. Then, there is no more connection in terms of flow dynamics.

Depending on the configuration, the line 19 may be connected with the discharge pipe 2 in another way and/or be provided integrally.

Then, for example a flexible connection and/or use of a flexible tube or hose is advantageous to ensure displacing of the discharge pipe 2.

While particular embodiments of the present emptying device and method for emptying a silo of a packaging system have been described herein, it will be appreciated by those skilled in the art that changes and modifications may be made thereto without departing from the invention in its broader aspects and as set forth in the following claims.

LIST OF REFERENCE NUMERALS

1 emptying device
2 discharge pipe
3 take-up opening
4 longitudinal extension
5 transverse extension
6 effective angle
7 protective device
8 dedusting device
9 cross section
10 wall
11 displacement mechanism
12 displacement mechanism
13 suction funnels
14 dust removal line
15 rest position
16 emptying position
17 edge
18 intermediate position
19 line
100 packaging system
101 silo
102 filling station
103 filling spout
104 filling turbine
105 housing structure
106 clearing device
107 center of rotation
108 discharge cone
200 bag

The invention claimed is:

1. An emptying device for completely emptying at least one silo of at least one rotary packaging system configured for rotation during operation, comprising:

at least two filling stations with at least one filling spout each; comprising at least one discharge pipe with at least one take-up opening;

wherein the longitudinal or lateral extension of the take-up opening is larger than its transverse extension and is constructed and arranged so that the filling spout is in functional communication with the take-up opening for receiving material from the filling spout as the packaging system, including said filling spout, rotates.

2. The emptying device according to claim 1, wherein the take-up opening is adapted to the circumference of the packaging machine.

3. The emptying device according to claim 1, wherein the take-up opening comprises at least one effective angle.

4. The emptying device according to claim 1, wherein in the transverse extension, the take-up opening shows a substantially U-shaped and/or V-shaped cross section.

5. The emptying device according to claim 1, wherein the discharge pipe is provided pivotable at least in sections.

6. The emptying device according to claim 1, wherein the discharge pipe is provided traversable at least in sections.

7. The emptying device according to claim 1, wherein the take-up opening is provided with at least one protective device.

8. The emptying device according to claim 1, wherein at least one dedusting device is assigned to the take-up opening.

9. The emptying device according to claim 1, wherein the emptying device is configured mobile.

10. A rotary packaging system comprising at least one silo, at least two filling stations with at least one filling spout each in connection with the silo, and at least one emptying device according to claim 1.

11. A method for completely emptying a silo of a rotary packaging system with at least two filling stations with at least one filling spout each and at least one emptying device according to claim 1;

wherein the packaging system rotates continuously during emptying.

12. The method according to claim 11, wherein the packaging system rotates at a reduced peripheral speed compared to a filling operation.

13. The method according to claim 11, wherein the discharge pipe is traversed and/or pivoted when changing filling spouts.

14. The method according to claim 11, wherein at least one filling turbine, conveys the residual product out of the rotating silo and into the take-up opening through the filling spout when passing it.

15. The method according to claim 11, wherein the packaging machine keeps rotating until the silo is completely emptied by way of emptying at intervals through the filling spouts.

* * * * *